US005690561A

United States Patent [19]

Rowland et al.

[11] Patent Number: 5,690,561

[45] Date of Patent: Nov. 25, 1997

[54] REMOVABLE ADHESIVE BACKED PADS FOR GOLF CLUB STRIKING SURFACES

[75] Inventors: Michael L. Rowland; David L. Ballard, both of Kingwood, Tex.

[73] Assignee: The Spin Doctor, Ltd., Kingwood, Tex.

[21] Appl. No.: 676,434

[22] Filed: Jul. 8, 1996

Related U.S. Application Data

[63] Continuation-in-part of Ser. No. 597,974, Feb. 7, 1996.

[51] Int. Cl.[6] ..... A63B 53/04

[52] U.S. Cl. ..... 473/330; 473/331; 473/342; 473/288

[58] Field of Search ..... 473/329, 330, 473/342, 331, 288

[56] References Cited

U.S. PATENT DOCUMENTS

| | | | |
|---|---|---|---|
| 1,094,599 | 4/1914 | Samson . | |
| 2,447,967 | 8/1948 | Stone | 273/77 |
| 2,660,436 | 11/1953 | Grossman | 273/77 |
| 2,908,502 | 10/1959 | Bradstreet et al. | 273/167 |
| 3,273,891 | 9/1966 | Grim, Jr. | 273/163 |
| 3,310,309 | 3/1967 | Moss | 273/162 |
| 3,721,447 | 3/1973 | Louderback | 273/186 |
| 3,989,861 | 11/1976 | Rasmussen | 427/180 |
| 4,768,787 | 9/1988 | Shira | 273/175 |
| 4,917,384 | 4/1990 | Caiati | 473/330 |
| 4,964,641 | 10/1990 | Miesch et al. | 473/330 |
| 5,029,865 | 7/1991 | Kim | 273/175 |
| 5,033,746 | 7/1991 | Jones | 273/186 |
| 5,125,655 | 6/1992 | Crooks | 273/32 |
| 5,299,807 | 4/1994 | Hutin | 273/173 |
| 5,310,185 | 5/1994 | Viollaz et al. | 273/167 |
| 5,354,059 | 10/1994 | Stuff | 473/342 X |
| 5,362,047 | 11/1994 | Shaw et al. | 273/77 |
| 5,425,538 | 6/1995 | Vincent et al. | 273/167 |
| 5,445,386 | 8/1995 | Marshall | 273/194 |

FOREIGN PATENT DOCUMENTS

| | | |
|---|---|---|
| 268181 | 6/1966 | Australia . |

*Primary Examiner*—George J. Marlo
*Attorney, Agent, or Firm*—Pravel, Hewitt, Kimball & Krieger

[57] ABSTRACT

A two-sided removable pad for use on a golf club having a substantially planar club face surface for striking a golf ball. A ball contact surface having a plurality of ridges effects the rotation of a struck golf ball. An adhesive on a second side of the pad for application to the club face. The pad is easily removably adhered to the club face surface.

15 Claims, 3 Drawing Sheets

FIG.1
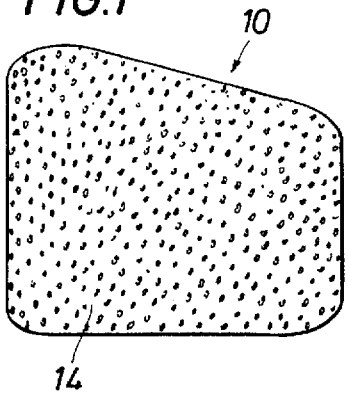
FIG.2
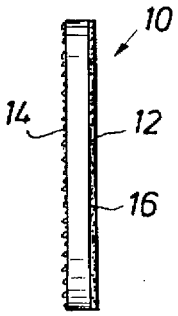
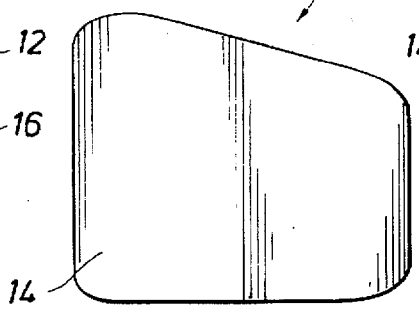
FIG.3
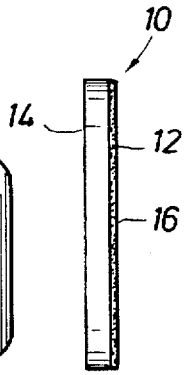
FIG.4
FIG.5
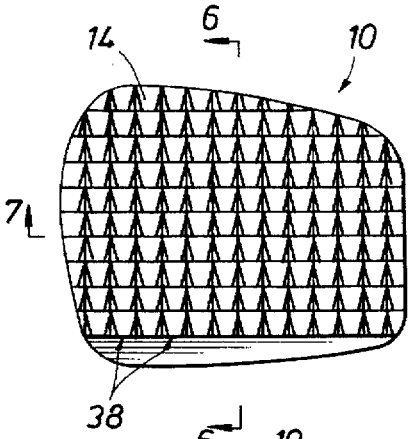
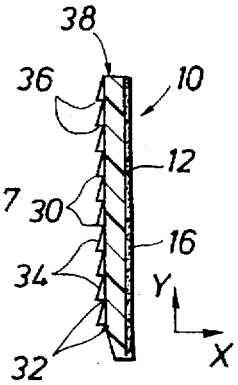
FIG.6
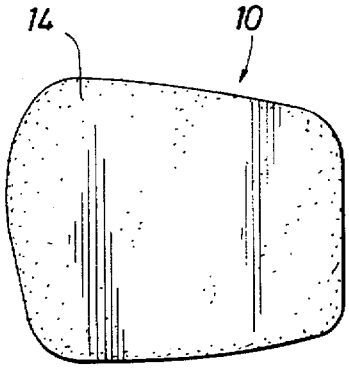
FIG.8
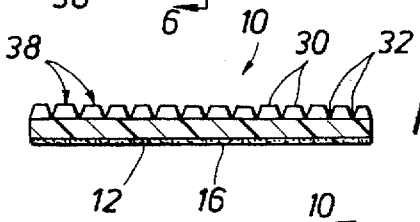
FIG.7
FIG.9
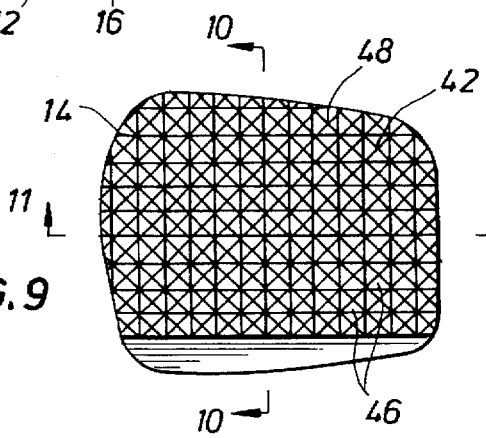
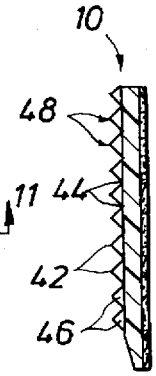
FIG.10
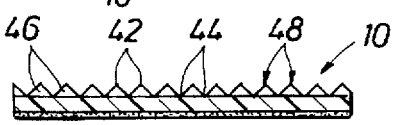
FIG.11

FIG. 12
(PRIOR ART)
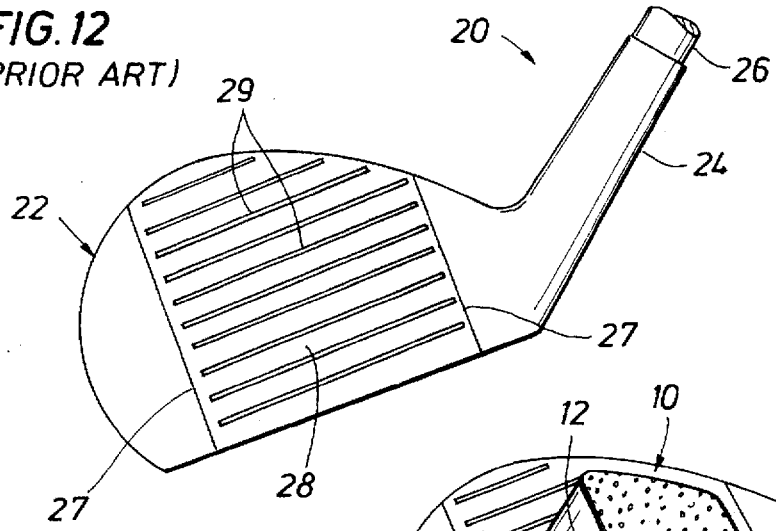
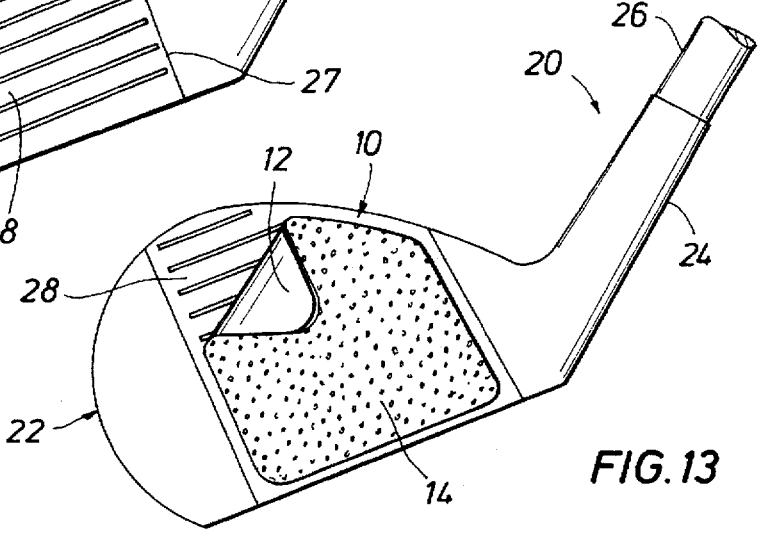
FIG. 13
FIG. 14
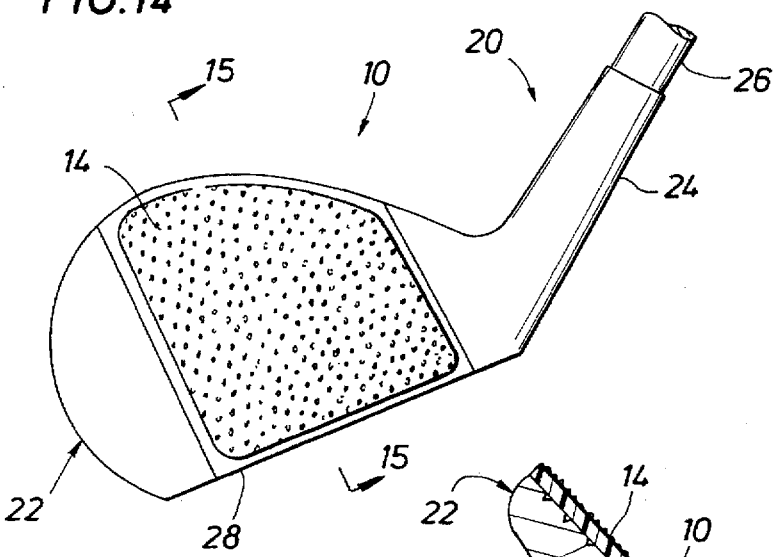
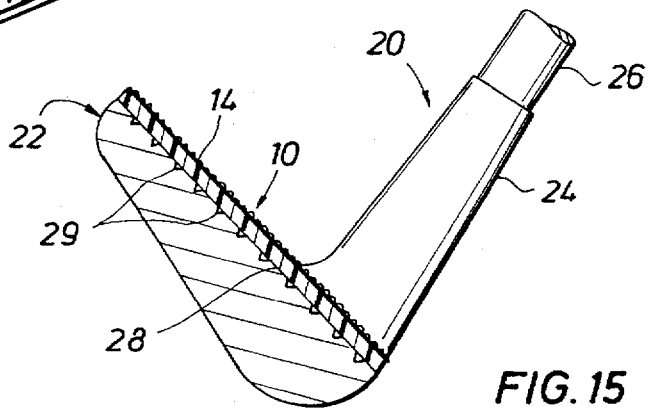
FIG. 15

FIG. 16
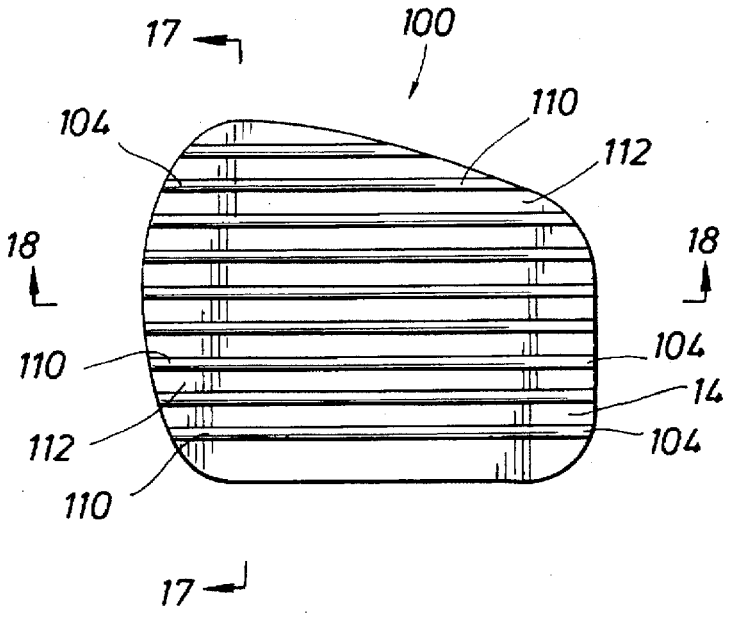
FIG. 17
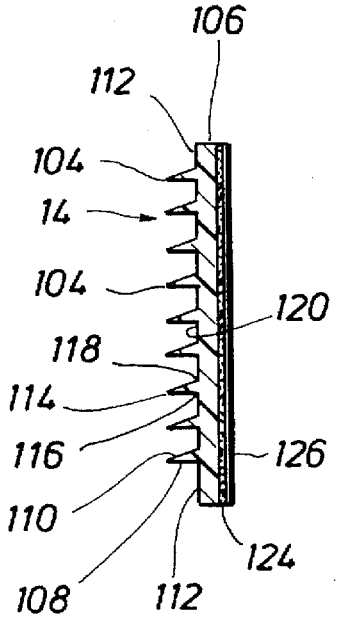
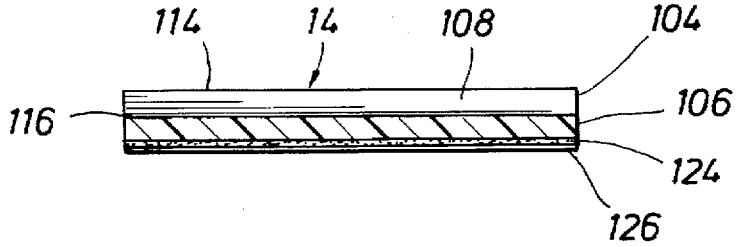
FIG. 18

REMOVABLE ADHESIVE BACKED PADS FOR GOLF CLUB STRIKING SURFACES

CROSS-REFERENCE TO RELATED APPLICATION

This is a continuation-in-part patent application of U.S. patent application Ser. No. 08/597,974, filed Feb. 7, 1996.

BACKGROUND OF THE INVENTION

1. Field of the Invention

The present invention relates in general to golf clubs and, in particular, to the head of a golf club having a substantially planar club face surface for striking a golf ball.

2. Description of the Prior Art

Most golf clubs, often referred to as irons and woods, have a substantially planar club face surface for striking a golf ball. Typically, this club face contains a frictional element or surface roughness that imparts a rotational spin to the golf ball upon contact. Excessive spin of the golf ball is not desirable on a drive since it may cause a slice or a hook. However, spin of the golf ball, preferably back spin, is desirable on shorter shots for controlling the ball's flight trajectory and for minimizing the ball's rolling distance after the ball lands on the green.

Typically, most golf clubs impart some form of spin. Even if the club face hits the ball flat, the horizontal and vertical grooves or other face irregularities on the striking face on the driver or woods may still impart a slight spin. Furthermore, those clubs with more loft such as the number 7, 8, 9 clubs and the wedges are intended to impart more back spin and increase the trajectory height of a ball in an effort to minimize the ball's rolling distance after it lands on the green. Again, to do this such clubs typically include horizontal grooves within the club face. Additionally, a grit containing hard particles or a coating of plastic adhesive may be applied to the club face to provide greater friction between the ball and the club face. Thus, a conventional golf club, particularly one for shorter shots, includes some combination of horizontal grooves and frictional finishes for imparting back spin to a golf ball.

Several disadvantages exist with the conventional golf club's grooves and frictional finishes. For example, the frictional finish's useful life may be relatively short. Once the coating wears off, the grooves provide the only practical means of introducing back spin. As a result, a golfer must periodically purchase a new club to maintain the proper frictional element on the club face. For most golfers, the grooves alone are insufficient for achieving the desired back spin.

Another disadvantage is that the frictional element of a new conventional golf club may be insufficient for the novice to obtain a desirable back spin. Most new golf clubs contain a standard degree of surface roughness. The standard roughness usually complies with the golf professionals' governing body, the United States Golf Association ("USGA"). The USGA's club roughness standard serves the useful purpose of assuring that all golfers participating in golf tournaments use similar type clubs. The USGA standards, however, are not particularly useful for the weekend golf warrior facing an island green with a conventional pitching wedge. As a result of conventional golf clubs complying with the USGA standard, many golfers need greater surface roughness on their club faces then presently available on new golf clubs.

Similarly, because a conventional golf club's surface roughness is standardized, it is difficult for one club surface to sufficiently accommodate all playing conditions and all golfers. For example, on a day when the greens are hard and dry, a golfer will need to put more backspin on the ball to make it stick on the green. Under such conditions, a golfer desires a club face surface with more roughness so the club imparts as much backspin as possible to the ball. In contrast, on a wet or damp day when the greens are soft and slow, a golfer will need less backspin and thus will need a less rough club face. Although a professional golfer is adept at using a single roughness club under varying course conditions, most golfers would prefer to have club faces with varying degrees of surface roughness to achieve a desired back spin under all conditions. Thus, a golfer must purchase several clubs, each for use under a different condition.

Prior patents have realized the advantages of greater surface roughness on the club face surface by adhering carbides and other hard particles to the striking surface of golf clubs. For example, in U.S. Pat. No. 4,917,384 to Caiati there is a disclosure of adhering diamond particles directly to the club face of a smooth driver face, that is, one without grooves. However, the Caiati golf club, like a conventional golf club, loses its surface roughness over time. Moreover, because the Caiati club face does not contain grooves, but rather is smooth prior to adhering particles, it is of little use to the golfer when the particles wear off. The golfer must either purchase a new golf club or adhere new diamond particles. Additionally, because the particles are permanently adhered to the club face, the golfer may need to purchase several clubs of differing roughness to achieve a desired back spin. See also Australian Patent Specification No. 268181.

Similarly, U.S. Pat. No. 4,768,787 to Shira discloses embedding hard particles into the golf club face. Although embedding particles has the advantage of longer roughness life then adhering particles to the golf club face, it still suffers from the disadvantage of requiring the golfer to purchase several different clubs of varying roughness.

It would be desirable to have a more consistent striking surface for a conventional golf club that provides a preferred frictional element.

SUMMARY OF THE INVENTION

The present invention provides a removable pad having a frictional surface for engaging a golf ball and applying a spin to the golf ball when the golf ball is struck by a golf club. The pad is removably adhered to a striking face of the golf club. Removal of the pad is easy and convenient. The use of the pad does not permanently alter the face of a conventional golf club.

In the preferred embodiment, the pad includes a substantially planar body having a facial surface which includes a plurality of ridges and an opposing back surface. A layer of adhesive material is adhered to the back surface for removably securing the pad to the golf club.

BRIEF DESCRIPTION OF THE DRAWINGS

A better understanding of the present invention can be obtained when the following detailed description of the preferred embodiment is considered in conjunction with the following drawings, in which:

FIG. 1 is a front view of the rough textured adhesive backed pad of the present invention;

FIG. 2 is a side view of the pad of FIG. 1;

FIG. 3 is a front view of the smooth textured adhesive backed pad of the present invention;

FIG. 4 is a side view of the pad of FIG. 3;

FIG. 5 is a front view of a molded, rough textured adhesive backed pad of the present invention;

FIG. 6 is an enlarged view taken along lines 6—6 of FIG. 5;

FIG. 7 is an enlarged view taken along lines 7—7 of FIG. 5;

FIG. 8 is a front view of a rubber textured adhesive backed pad of the present invention;

FIG. 9 is a front view of a molded rough textured adhesive backed pad of the present invention;

FIG. 10 is an enlarged view taken along lines 10—10 of FIG. 9;

FIG. 11 is an enlarged view taken along lines 11—11 of FIG. 9;

FIG. 12 is a perspective view of a prior art golf club head;

FIG. 13 is a perspective view of the adhesive backed pad as partially installed on a golf club head;

FIG. 14 is a perspective view of the adhesive backed pad as generally installed on a golf club head;

FIG. 15 is a view taken along lines 15—15 of FIG. 14;

FIG. 16 is a front view of an adhesive backed pad having a plurality of substantially parallel ridges, according to the present invention;

FIG. 17 is a cross sectional view of the pad of FIG. 16 taken along lines 17—17 in FIG. 16; and FIG. 18 is a cross sectional view of the pad of FIG. 16 as seen along the lines 18—18 in FIG. 16.

DETAILED DESCRIPTION OF PREFERRED EMBODIMRNT

Referring now to the drawings in more detail, FIGS. 1 and 2 are front and side views, respectively, of a rough textured adhesive backed pad 10 for use on a golf club face 28 (FIG. 12). Similarly, FIGS. 3 and 4 are front and side views, respectively, of a smooth textured adhesive backed pad 10 for use most often on a driver or wood or a lower numbered iron. The smooth surface eliminates the friction normally found on the face of the drivers or long irons and thus tends to eliminate or minimize spin.

The pad 10 includes a back surface 12 and a ball contact surface 14. Applied to the back surface 12 is an adhesive coating 16. Preferably, the adhesive coating 16 includes a double-sided tape which adheres to the back surface 12. In operation, the adhesive coating 16 adheres the pad 10 to the club face 28 (FIG. 12). Alternatively, the adhesive coating 16 may include a rubber or an acrylic based bonding agent or any other suitable bonding agent that provides a temporary bond between the present invention and the club face 28.

As shown in FIG. 1, the ball contact surface 14 of the pad 10 is generally rough in texture. Preferably, the ball contact surface 14 includes micron sized tungsten carbide granules of varying shapes. As may be appreciated, a rough ball contact surface 14 may include aluminum oxide or other types of granules that are micron size and have the textured feel of a fine grit sandpaper. In operation, abrasive granules providing the best spin properties range in size from about a 36 grit sandpaper to about an 80 grit sandpaper.

Alternatively, as shown in FIG. 8, the ball contact surface 14 may include a rubber coated material. The rubber coated material has the rough textured feel of a fine grit sandpaper. In operation, the rubber coated material imparts backspin similar to that of tungsten carbide granules. The rubber coated material, however, does not scuff the ball like the tungsten carbide granules.

Alternatively, as shown in FIGS. 5–7, a rough ball contact surface 14 may include a plurality of horizontally spaced ribs 38. As shown in FIG. 6, each rib 38 includes a multitude of peaks 30 and valleys 32 connected by inclined surfaces 34 and horizontal surfaces 36. As shown, the inclined surface 34 connects a valley 32 to an adjacent peak 30 with a lower Y-value. Similarly, the horizontal surface 36 connects a peak 30 to an adjacent valley 32 with a greater X-value. In the preferred embodiment, the distance between a peak 30 and valley 32 along the x-axis is 1/32th of an inch. Similarly, as shown in FIG. 7, width of a rib 38 at a peak 30 is 1/32th of an inch. Preferably, the ribs 38 are made of plastic and are horizontally spaced such that the ribs 38 abut one another at the valley 32 positions. In operation, the ribs 38 provide backspin similar to that imparted by the tungsten carbide granules. The plastic ribs 38, however, are more durable and thus do not wear out as fast as the tungsten carbide granules. As can be appreciated, the ribs 38 may be made from materials other than plastic such as steel or aluminum.

Alternatively, as shown in FIGS. 9–11, a rough ball contact surface 14 may include a plurality of horizontally and vertically spaced pyramids 48. As shown in FIG. 9, the pyramids 48 generally include four triangular faces 46 having a common peak 42. As shown in FIGS. 10 and 11, each triangular face 46 includes two base points 44 and a peak 42. Typically, the distance between base points 44 is about 1/32th of an inch. Similarly, the vertical distance from a base point 44 to a peak 42 is 1/32th of an inch. Preferably, the pyramids 48 are made of plastic and horizontally spaced such that the pyramids 48 abut one another at the base points 44. As can be appreciated, the pyramids 48 may be made from materials other than plastic such as steel or aluminum.

As shown in FIG. 12, the prior art golf club 20 is represented by an iron with a substantially planar club face surface. The golf club 20, whether an iron or a wood, is typically a conventional golf club having a head 22 and a shank 24 connected to an elongated shaft 26. The club face 28 of the head 22 is generally planar and polygonal shaped, as defined by the vertical lines 27 and their intersection with the perimeter of the club head 22. Additionally, the club face 28 is horizontally grooved, as indicated by the lines 29. The grooves 29 are coextensive with the width of the club face 28 and vertically spaced throughout the medial portion of the club face 28.

As shown in FIG. 13, the pad 10 is applied to the golf club 20 by pressing the back surface 12, with the adhesive coating 16 previously applied to it (not shown), against the club face 28. In contrast, removal of the pad 10 is performed simply by peeling the pad 10 from the club face 28. FIGS. 14 and 15 show the pad 10 completely adhered to the club face 28 and in its operative position on the golf club 20.

The pad 10 can be made of varying roughness. Each individual pad of varying roughness will provide a different degree of backspin to accommodate fairway and green conditions, as well as varying golfer ability. In practice, a set of pads can be carried in a golf bag and the golfer can select and apply a particular pad roughness depending upon the shot he is facing and the desired backspin. Additionally, because the pads can be readily applied and removed from the golf club face, a golfer will not need to purchase additional expensive clubs to obtain the same frictional element as the pads provide. As may be appreciated, the more coarse the pad, the greater the backspin applied to a struck golf ball. On long approach shots to the green (typically 50 yards or more), however, a coarse grit pad may cause undesirable scuffing of the ball. Under such conditions, a golfer may use the rubberized nonskid pad which imparts sufficient backspin for long approach shots but does not cause scuffing of the ball.

In the embodiment shown in FIGS. 16–18, a pad 100 is shown for use on golf club face 28. FIG. 16 shows a front view of pad 100, and FIGS. 17 and 18 show cross sectional view taken along lines 17—17 and 18—18 of FIG. 16, respectively. The ball contact surface 14 for the pad 100 includes a plurality of spaced ridges 104 projecting from a body 106. Ridges 104 are continuous in length and are shown extending horizontally and spaced vertically from each other in FIG. 16. Horizontally as used herein means they transverse club face 28 in the same general orientation or direction as grooves 29 of original club face 28. The ridges 104 and body 106 are preferably integrally formed using a plastic material in a molding operation.

Each ridge 104 includes a perpendicular surface 108 and an angled surface 110. Perpendicular surfaces 108 extend or project substantially perpendicularly from a facial surface 112 of body 106. Angled surfaces 110 extend or project at an angle from facial surface 112. Perpendicular surface 108, angled surface 110, and facial surface 112 intersect, forming a right triangle as the cross-sectional shape of each ridge 104.

Thus, the cross section of each ridge 104 can be described as a right triangle formed on body 106. Perpendicular surface 108 and angled surface 110 intersect at a peak or an apex 114. Apex 114 is the top line along each ridge 104 which strikes the surface of the golf ball and imparts a back spin. Perpendicular surface 108 and facial surface 112 intersect at a right-angled base point 116. Facial surface 112 and angled surface 110 intersect at an acute-angled base point 118. Apex 114, right-angled base point 116, and acute-angled base point 118 define a right triangle, and the intersection of perpendicular surface 108 and facial surface 112 form the right angle in the right triangle.

Each ridge 104 is preferably about 1/16 of an inch long between right-angled base point 116 and acute-angled base point 118. Each ridge 104 preferably extends about 3/64 of an inch along perpendicular surface 108 from or above facial surface 112. Each ridge 104 is separated from an adjacent ridge 104 by a gap 120. Gap 120 is preferably about 1/8 of an inch as measured from the acute-angled base point 118 of one ridge 104 to the right-angled base point 116 of an adjacent ridge 104.

Body 106 of pad 100 has a layer of adhesive material 124. A paper sheet 126 covers adhesive material 124. Paper sheet 126 preferably has a waxy coating that allows paper sheet 126 to be easily removed from adhesive material 124. Paper sheet 126 allows pad 100 to be handled easily during packaging and transport since paper sheet 126 covers adhesive material 124, rendering pad 100 nonsticky.

Pad 100 can be made by first making a form having a negative shape for pad 100. A liquid material is poured into the negative shape and hardened or set into a flexible and resilient plastic sheet. The plastic sheet is coated on one side with adhesive material 124, and paper sheet 126 is placed upon adhesive material 124. The plastic sheet is cut or stamped to form pad 100.

Pad 100 is used by peeling off paper 126 from adhesive material 124. Pad 100 is removably adhered to club face 28 by pressing pad 100 onto club face 28 with adhesive material 124 contacting club face 28. After pad 100 has been used, the golfer may pull pad 100 off club face 28 by grasping and pulling with his or her hands.

When the golfer hits the golf ball while using pad 100 on club face 28, apex lines 114 of ridges 104 contact the surface of the golf ball. While apex lines 114 primarily contact the surface of the golf ball, a portion of surface 108 may also contact the surface of the golf ball depending on the elasticity of the material used to make pad 100 and the durability of the coating of the golf ball. Thus, apex lines 114, and possibly a portion of perpendicular surfaces 108, momentarily grip the golf ball as club face 28 lifts and passes underneath the golf ball, causing the golf ball to spin backwards during its flight, which is desirable.

The foregoing disclosure and description of the invention are illustrative and explanatory thereof, and various changes in the size, shape, and materials may be made without departing from the spirit of the invention.

What is claimed is:

1. A device for use on a golf club having a generally planar club head striking face comprising a two-sided removable pad having dimensions corresponding generally to those of the striking face of a golf club head, said pad having a first side including a plurality of continuous ridges extending generally horizontally and spaced vertically from each other, the continuous horizontal extent of said ridges corresponding generally to the width of said pad, and an adhesive coating on a second side of said pad for temporary application to a club head striking face, said ridges being firm enough to impart spin to a golf ball yet not significantly mar the surface of the golf ball.

2. The device of claim 1 wherein each said ridge has a triangular cross-sectional shape.

3. The device of claim 2 wherein each said ridge has a right triangular cross-sectional shape.

4. The device of claim 2 wherein said triangle has a first surface substantially perpendicular to said first side.

5. The device of claim 1 wherein said plurality of ridges are substantially parallel.

6. The device of claim 1 further comprising a paper sheet removably adhered to said adhesive coating.

7. A set of pads each of which corresponds to the structure defined by claim 1 wherein each pad is sufficiently different to provide a different degree of backspin to accommodate fairway and green conditions, as well as varying golfer ability.

8. A removable striking face pad for a golf club comprising:

a generally planar body having dimensions corresponding generally to those of a golf club head striking face and having first and second opposing surfaces, said first surface including a plurality of generally parallel continuous ridges extending generally horizontally and spaced vertically from each other, the continuous horizontal extent of said ridges corresponding generally to the width of said pad, and said ridges being firm enough to impart spin to a golf ball yet not significantly mar the surface of the golf ball;

said opposing second surface of said pad including a layer of adhesive material for temporarily securing the pad to the striking face of a golf club head.

9. The device of claim 8 wherein each said ridge has a triangular cross-sectional shape.

10. The device of claim 9 wherein each said ridge has a right trianglular cross-sectional shape.

11. The device of claim 9 wherein said triangle has a first surface substantially perpendicular to said first surface of the pad.

12. The device of claim 8 further comprising a paper sheet removably adhered to said adhesive material.

13. A set of pads each of which corresponds to the structure defined by claim 8 wherein each pad is sufficiently different to provide a different degree of backspin to accommodate fairway and green conditions, as well as varying golfer ability.

14. A device for use on a golf club having a generally planar club head striking face comprising a two-sided temporary and removable pad having dimensions corresponding generally to those of the striking face of a golf club head, said pad having first and second sides, said first side including a plurality of generally parallel continuous ridges extending generally horizontally and vertically spaced from each other, the continuous horizontal extent of said ridges corresponding generally to the width of said pad, and an adhesive coating on said second side of said pad for application to a club head striking face, said pad being firm enough to impart spin to a golf ball yet not significantly mar the surface of the golf ball.

15. A set of pads each of which corresponds to the structure defined by claim 14 wherein each pad is sufficiently different to provide a different degree of backspin to accommodate fairway and green conditions, as well as varying golfer ability.

* * * * *